US006747414B2

(12) United States Patent
Yoshida

(10) Patent No.: US 6,747,414 B2
(45) Date of Patent: Jun. 8, 2004

(54) AC PLASMA DISPLAY PANEL

(75) Inventor: Kunio Yoshida, Tokyo (JP)

(73) Assignee: NEC Plasma Display Corporation, Tokyo (JP)

( * ) Notice: Subject to any disclaimer, the term of this patent is extended or adjusted under 35 U.S.C. 154(b) by 0 days.

(21) Appl. No.: 10/281,118

(22) Filed: Oct. 28, 2002

(65) Prior Publication Data

US 2003/0080690 A1 May 1, 2003

(51) Int. Cl.[7] ..... G09G 3/10
(52) U.S. Cl. ..... 315/169.1; 313/581
(58) Field of Search ..... 315/169.1; 313/586, 313/581, 582, 583, 584, 585, 609; 345/55

(56) References Cited

U.S. PATENT DOCUMENTS

| | | | | |
|---|---|---|---|---|
| 6,157,128 | A | * 12/2000 | Namiki et al. | 313/581 |
| 6,400,081 | B1 | * 6/2002 | Matsumoto et al. | 313/582 |
| 6,479,932 | B1 | * 11/2002 | Nunomura | 313/582 |
| 6,486,611 | B2 | * 11/2002 | Tokunaga et al. | 315/169.4 |
| 6,512,330 | B2 | * 1/2003 | Nakajima et al. | 313/586 |
| 6,566,812 | B1 | * 5/2003 | Torisaki et al. | 313/586 |
| 2001/0026113 | A1 | * 10/2001 | Amemyia et al. | 313/586 |

FOREIGN PATENT DOCUMENTS

| | | | |
|---|---|---|---|
| JP | 10-233171 | A | 9/1998 |
| JP | 11-297214 | A | 10/1999 |
| JP | 2000-106090 | A | 4/2000 |
| JP | 2000-294149 | A | 10/2000 |

* cited by examiner

*Primary Examiner*—Wilson Lee
*Assistant Examiner*—Thuy Vinh Tran
(74) *Attorney, Agent, or Firm*—Sughrue Mion, PLLC

(57) ABSTRACT

A plasma display panel is provided which is capable of improving efficiency of light emission and of achieving a stable operation with a driving margin being kept wide by keeping a discharge initiating voltage low and by maintaining an erroneous discharge voltage high. Each of first electrode portions of transparent electrodes formed on a first substrate forms a clearance being smaller than a width of each of partition walls on each of the partition walls formed between discharge cells being adjacent to each other in a row direction on a screen. Each of second electrode portions is formed apart from each of the partition walls. Each of third electrode portions is so constructed that its width in the row direction on the screen is smaller than that of each of second electrode portions.

22 Claims, 9 Drawing Sheets

AC PLASMA DISPLAY PANEL

The present application claims priority of Japanese Patent Application No. 2001-330647 filed on Oct. 29, 2001, which is hereby incorporated by reference.

BACKGROUND OF THE INVENTION

1. Field of the Invention

The present invention relates to an AC plasma display panel used for an information displaying terminal, flat-panel television, or a like and more particularly to a structure of the AC plasma display panel.

2. Description of the Related Art

Currently various types of AC plasma display panels are available for use. A three-electrode-surface-discharge type of AC (Alternating Current) plasma display panel is so configured that, on a front substrate being one of two substrates are formed a scanning electrode and a common electrode and on a rear substrate being another of the two substrates is formed a data electrode in which writing discharge to select a unit cell to be displayed is performed by driving the data electrode and the scanning electrode while sustaining discharge is performed by surface discharge of the selected unit cell by driving the scanning electrode and the common electrode.

In the three-electrode-surface-discharge type of AC plasma display panel, since ions having high energy being generated at a time of surface discharge on the front substrate move on a plane in a unit cell of the front substrate, a fluorescent material on the rear substrate can avoid interaction with ions and as a result be prevented from deteriorating and, therefore, a lifetime of this type of AC plasma display panel can be made longer and the plasma display is widely used.

FIG. 7 is a cut-away perspective view showing a structure of a conventional three-electrode-surface-discharge type of AC plasma display panel. FIG. 8 is a cross-sectional view of the conventional plasma display panel taken along a line E—E. FIG. 9 is a cross-sectional view of the conventional plasma display panel of FIG. 8 taken along a line F—F.

In the conventional three-electrode-surface-discharge-type of AC plasma display panel, as shown in FIG. 7 to FIG. 9, on a front substrate 10 constructed of a transparent substrate are formed a plurality of scanning electrodes 5, each of which, is made up of a first transparent electrode 1 and a first metal electrode line 3, and a plurality of common electrodes 6, each of which, is made up of a second transparent electrode 2 and a second metal electrode line 4, in such a manner that a discharge gap 7 may be interposed between each scanning electrode 5 and each common electrode 6 adjacent to each other, and the scanning electrodes 5 and the common electrodes 6 are coated with a dielectric layer 11*a* and further the dielectric layer 11*a* is covered with a protective layer 12.

On the other hand, on a rear substrate 13 constructed of a transparent substrate are formed a plurality of data electrodes 14 which are covered with a dielectric layer 11*b*. Each of belt-shaped partition walls 15 is formed on the dielectric layer 11*b* and positioned between data electrodes 14 being adjacent to each other.

As shown in FIG. 8, fluorescent materials 16R, 16G, and 16B providing light having three primary colors including light with a red color, light with a green color, and light with a blue color, respectively, are alternately coated (That is to say R, G, B, R, G, B, . . . ) on a surface of the dielectric layer

11*b* and a side face of each of the belt-shaped partition walls 15. Between the front substrate 10 and the rear substrate 13 are integrally assembled the scanning electrode 5, the common electrode 6, and the data electrode 14 in a manner that they face one another to be orthogonal to one another and in a discharge space 17 being a space between the front substrate 10 and the rear substrate 13 is filled gas emitting ultraviolet rays in an excited state by discharge.

In the conventional plasma display panel described above, three kinds of electrodes including the scanning electrode 5, the common electrode 6, and the data electrode 14 are arranged for every unit cell 9*a* and one pixel in a screen is made up of three unit cells 9*a* including the fluorescent materials 16R, 16G, and 16B.

Moreover, among unit cells 9*a* being adjacent to one another in a column direction V is formed a non-discharge gap 8 to prevent interference against discharge among unit cells 9*a*.

Furthermore, since an upper face of each of the belt-shaped partition walls 15 is not covered by the first transparent electrode 1, redundant current being not accompanied by light emission is not consumed. Also, by placing the first transparent electrode 1 in a position being far from an end of each of the belt-shaped partition walls 15, a loss in charged particles is reduced and light emission efficiency is improved.

To drive the conventional plasma display panel described above, control is exerted in such a manner that, by driving the data electrode 14 and scanning electrode 5 using a data pulse and a scanning pulse respectively, writing discharge is performed and that the unit cell 9*a* to be displayed is selected and by driving the scanning electrode 5 and the common electrode 6, sustaining discharge is performed by surface discharge of the selected unit cell 9*a*.

Moreover, to perform sufficient gray-scale, eight to ten sub-fields are provided in one field and each sub-field includes a scanning period to perform writing discharge, a sustaining period to perform sustaining discharge, and a priming period to stabilize writing discharge.

However, the conventional plasma display as shown in FIG. 7 presents a problem in that a width in a row direction H on a screen between the first and second transparent electrodes 1 and 2 facing each other with the discharge gap 7 interposed between them is narrow, causing a discharge voltage to be made high.

Moreover, the conventional plasma display presents another problem in that, if the front substrate 10 and the rear substrate 13 are poorly positioned, the width between the first and second transparent electrodes 1 and 2 is made different depending on a unit cell 9*a* in a display surface, which causes distribution of discharge voltages to be widened and driving margin to be made narrow.

To solve these problems, an electrode is disclosed in, for example, Japanese Patent Application Laid-open No. Hei 11-297214 in which, as a result of considerations given to a possible influence of a discharge characteristic caused by positioning between a front substrate and a rear substrate, a width of a protruding portion of a transparent electrode has been changed. However, this electrode presents a problem in that, if the protruding portion of the transparent electrode is made slender, a discharge region decreases and, if the protruding portion of the transparent electrode is made thick, excessive charges are readily left on a protective layer in a vicinity of metal electrodes and which causes erroneous discharge.

Moreover, in the conventional plasma display panel shown in FIG. 7, many charges are accumulated in a vicinity of the first and second metal electrode lines 3 and 4 existing at a place being apart from the discharge gap 7 immediately before writing discharge and, by using these charges, the dielectric layer 11*a* performs writing discharge on the first and second metal electrode lines 3 and 4 being thinner than the first and second transparent electrodes 1 and 2.

To solve this problem, an electrode is disclosed in Japanese Patent Application Laid-open Nos. Hei 10-233171 and Hei 11-297214 in which a dielectric mounted on a metal electrode is formed so as to be thicker than a dielectric mounted on a transparent electrode and not to use discharge occurring on the metal electrode.

Furthermore, another electrode is also disclosed in Japanese Patent Application Laid-open Nos. 2000-106090 and 2000-294149 in which a transparent electrode and a metal electrode is not coupled in a portion facing a discharge space and therefore discharge is not expanded up to regions existing on the metal electrode and, as a result, discharge occurring on the metal electrode is not used.

However, in all the electrodes disclosed above, there are problems in that a writing discharge voltage becomes high, or that a writing operation is erroneously performed, when a charge is accumulated at a place being not far from a discharge gap.

SUMMARY OF THE INVENTION

In view of the above, it is an object of the present invention to provide a plasma display panel capable of widening a driving margin and of improving light emission efficiency by lowering a discharge initiating voltage and by increasing erroneous discharge voltage.

According to a first aspect of the present invention, there is provided a plasma display panel including:

a first substrate made up of a transparent material;

a second substrate placed in a manner so as to face the first substrate wherein gas generating ultraviolet rays by discharge excitation is filled in a hermetic manner between the first substrate and the second substrate;

a plurality of transparent electrodes formed on the first substrate, each of which is made up of a first electrode portion, a second electrode portion, and a third electrode portion each being different in a width in a row direction on a screen from;

a plurality of metal electrode lines extending in the row direction and connected to the transparent electrodes;

a plurality of discharge gap formed between the transparent electrodes being adjacent to each other in a column direction;

a plurality of discharge cells made up of a pair of the transparent electrodes out of the plurality of the transparent electrodes, and arranged in a matrix form in a space between the first substrate and the second substrate; and wherein, in each of the plurality of the discharge cells, the first electrode portion exists in a vicinity of the discharge gap formed on the first substrate or in contact with the discharge gap, both end portions which are respectively positioned on a partition wall between the discharge cells being adjacent to each other in a row direction on a screen, whereby a clearance between end portions of the first electrode portions being adjacent to each other in the row direction is smaller than a width of the partition wall, the second electrode portion is formed apparent from the metal electrode line, from the discharge gap and from the partition wall, and the third electrode portion in the row direction on the screen is formed in a vicinity of the metal electrode line or in contact with the metal electrode line, a width of the third electrode portion being smaller than that of the second electrode portion.

In the foregoing, a preferable mode is one wherein a width of each of the first electrode portions in the column direction on the screen is 30 $\mu$m to 80 $\mu$m.

Another preferable mode is one wherein each of the second electrode portions is formed apart from each of the partition walls by 10 $\mu$n to 50 $\mu$m.

Still another preferable mode is one wherein a width of each of the first electrode portions in the row direction on the screen is 20 $\mu$m to 100 $\mu$m.

Furthermore preferable mode is one wherein a width of each of the third electrode portions in the column direction on the screen is 20 $\mu$m to 100 $\mu$m.

Still furthermore preferable mode is one wherein a clearance between end portions of the first electrode portions being adjacent to each other in the row direction on the screen is 10 $\mu$m to 30 $\mu$m.

According to a second aspect of the present invention, there is provided a plasma display panel including:

a first substrate made up of a transparent material;

a second substrate being placed in a manner so as to face the first substrate wherein gas generating ultraviolet rays by discharge excitation is filled in a hermetic manner between the first substrate and the second substrate;

a plurality of discharge cells arranged in a matrix form in a space between the first substrate and the second substrate; and wherein each of the plurality of discharge cells is made up of a scanning electrode and a common electrode facing the scanning electrode through a discharge gap;

wherein the scanning electrode is made up of a first metal electrode line extending in a row direction on a screen and a first transparent electrode being connected to the first metal electrode line;

wherein the common electrode is made up of a second metal electrode line extending in the row direction on the screen and a second transparent electrode being connected to the second metal electrode line;

wherein each of partition walls extending in a column direction on the screen is formed between the scanning electrodes being adjacent to each other and between the common electrodes being adjacent to each other on the second substrate:

wherein each of the first transparent electrode and the second transparent electrode is made up of a first electrode portion, a second electrode portion and a third electrode portion each having a different width in the row direction on the screen and being formed integrally in the column direction on the screen;

wherein the first electrode portion exists in a vicinity of the discharge gap formed on the first substrate or in contact with the discharge gap, both end portions which are respectively positioned on a partition wall between the discharge cells being adjacent to each other in a row direction on a screen, whereby a clearance between end portions of the first electrode portions being adjacent to each other in the row direction is smaller than a width of the partition wall, wherein the second electrode portion is formed apparent from the metal electrode line, from the discharge gap and from the partition wall, and wherein the third electrode portion in the row direction on the screen is formed in a vicinity of the metal electrode line or in contact with the metal electrode line, a width of the third electrode portion being smaller than that of the second electrode portion.

According to a third aspect of the present invention, there is provided a plasma display panel including:

a first substrate made up of a transparent material;

a second substrate placed in a manner so as to face the first substrate wherein gas generating ultraviolet rays by discharge excitation is filled in a hermetic manner between the first substrate and the second substrate;

a plurality of transparent electrodes formed on the first substrate, each of which is made up of a first electrode portion, a second electrode portion, and a third electrode portion each being different in a width in a row direction on a screen from;

a plurality of metal electrode lines extending in the row direction and connected to the transparent electrodes;

a plurality of discharge gap formed between the transparent electrodes being adjacent to each other in a column direction;

a plurality of discharge cells made up of a pair of the transparent electrodes out of the plurality of the transparent electrodes, and arranged in a matrix form in a space between the first substrate and the second substrate; and wherein, in each of the plurality of the discharge cells, the first electrode portion is connected to another first electrode portion in the adjacent discharge cell in the row direction on the screen, the second electrode portion is formed apparent from the metal electrode line, from the discharge gap and from the partition wall, and the third electrode portion in the row direction on the screen is formed in a vicinity of the metal electrode line or in contact with the metal electrode line, a width of the third electrode portion being smaller than that of the second electrode portion.

According to a fourth aspect of the present invention, there is provided a plasma display panel including:

a first substrate made up of a transparent material;

a second substrate being placed in a manner so as to face the first substrate wherein gas generating ultraviolet rays by discharge excitation is filled in a hermetic manner between the first substrate and the second substrate;

a plurality of discharge cells arranged in a matrix form in a space between the first substrate and the second substrate; and wherein each of the discharge cells is made up of a scanning electrode and a common electrode facing the scanning electrode through a discharge gap;

wherein the scanning electrode is made up of a first metal electrode line extending in a row direction on a screen and a first transparent electrode being connected to the first metal electrode line;

wherein the common electrode is made up of a second metal electrode line extending in the row direction on the screen and a second transparent electrode being connected to the second metal electrode line;

wherein each of partition walls extending in a column direction on the screen is formed between the scanning electrodes being adjacent to each other and between the common electrodes being adjacent to each other on the second substrate;

wherein each of the first transparent electrode and the second transparent electrode is made up of a first electrode portion, a second electrode portion and a third electrode portion each having a different width in the row direction on the screen and being formed integrally in the column direction on the screen;

wherein, in each of the plurality of the discharge cells, the first electrode portion is connected to another first electrode portion in the adjacent discharge cell in the row direction on the screen, wherein the second electrode portion is formed apparent from the metal electrode line, from the discharge gap and from the partition wall, and wherein the third electrode portion in the row direction on the screen is formed in a vicinity of the metal electrode line or in contact with the metal electrode line, a width of the third electrode portion being smaller than that of the second electrode portion.

With the above configuration, since a width of each of the first electrode portions facing each other with the discharge gap being interposed between the first electrode portions can surely be large, even if a deviation in assembling between the front substrate and the rear substrate or a difference in contraction of the substrate caused by baking occurs, a discharge initiating voltage can be lowered.

With another configuration, since mounting of the transparent electrode portions not affecting much the discharge initiating voltage, for example, of the transparent electrode portions being placed on each of the partition walls is omitted; that is, since the second electrode portions and the third electrode portions are positioned apart from each of the partition walls so as not to cover each of the partition walls and, in order to ensure absolute luminance, the width of each of the second electrode portions in the row direction on the screen is set not to be excessively small, it is possible to avoid a flow of an excessive current and efficiency of light emission can be improved Moreover, since the width of the third electrode portions in the row direction on the screen is made smaller within a range in which writing discharge is not made high, an erroneous discharge voltage can be made higher. Therefore, since the discharge initiating voltage is low and the erroneous discharge voltage is high, a driving margin is made wider and stable operation can be achieved. Furthermore, since the first electrode portions are connected to each other in each of the discharge cells in the row direction on the screen, even if a breakage occurs in the third electrodes, since a current can be fed through the first electrode portions from discharge cells and therefore it is possible to operate each discharge cell in a stable manner.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

First Embodiment

Figure 1:
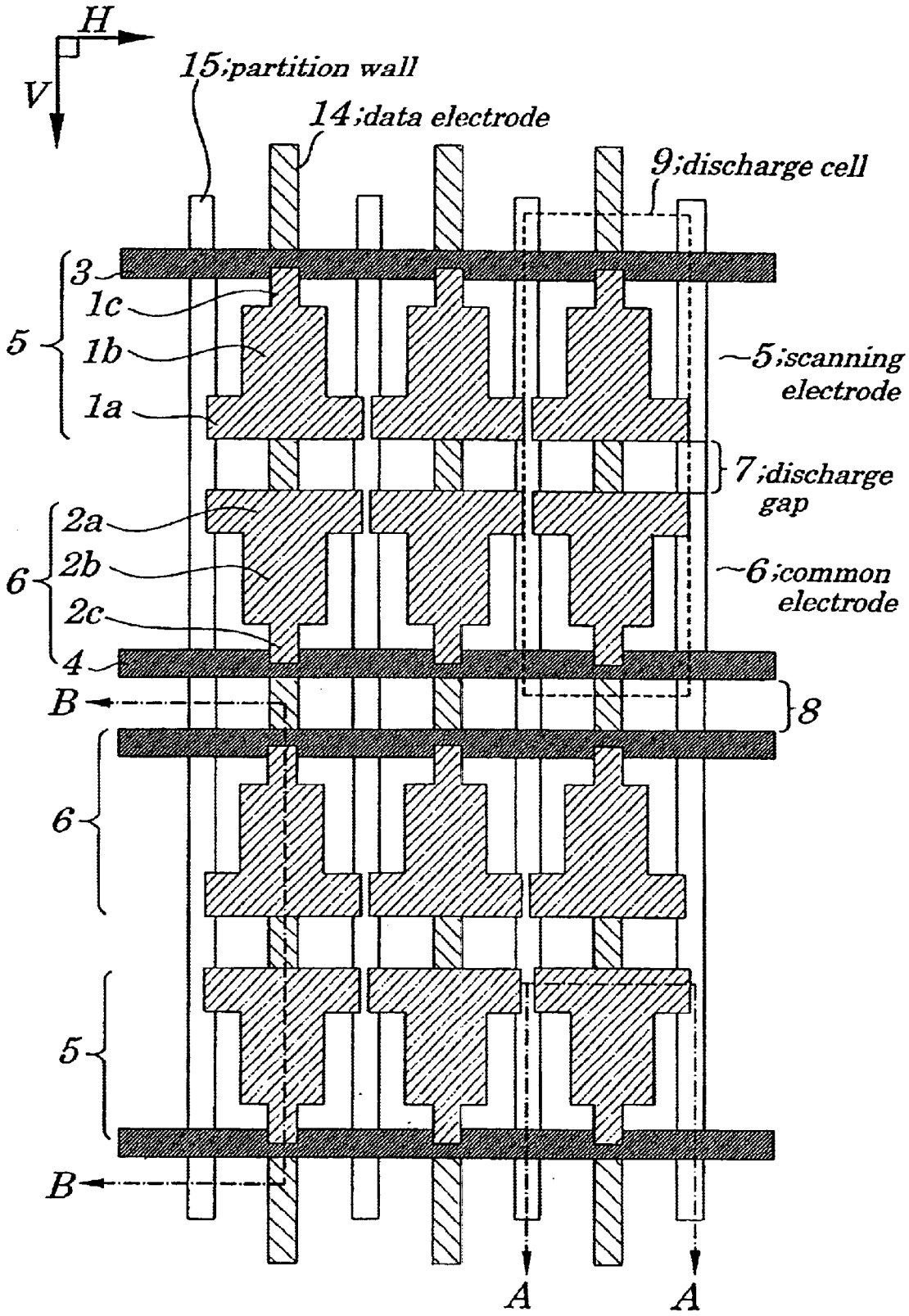
FIG. 1 is a plan view illustrating a plasma display panel according to a first embodiment of the present invention.
Figure 2:
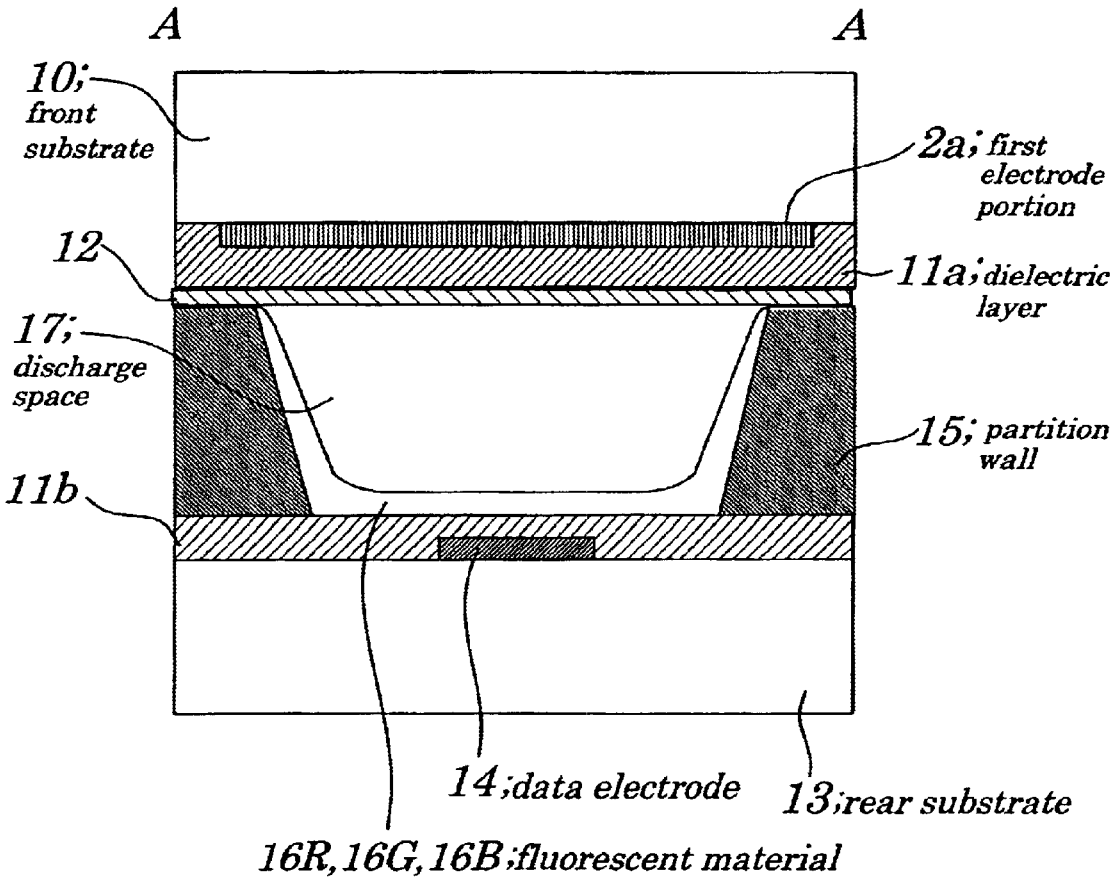
FIG. 2 is a cross-sectional view of the plasma display of FIG. 1 taken along a line A—A.
Figure 3:
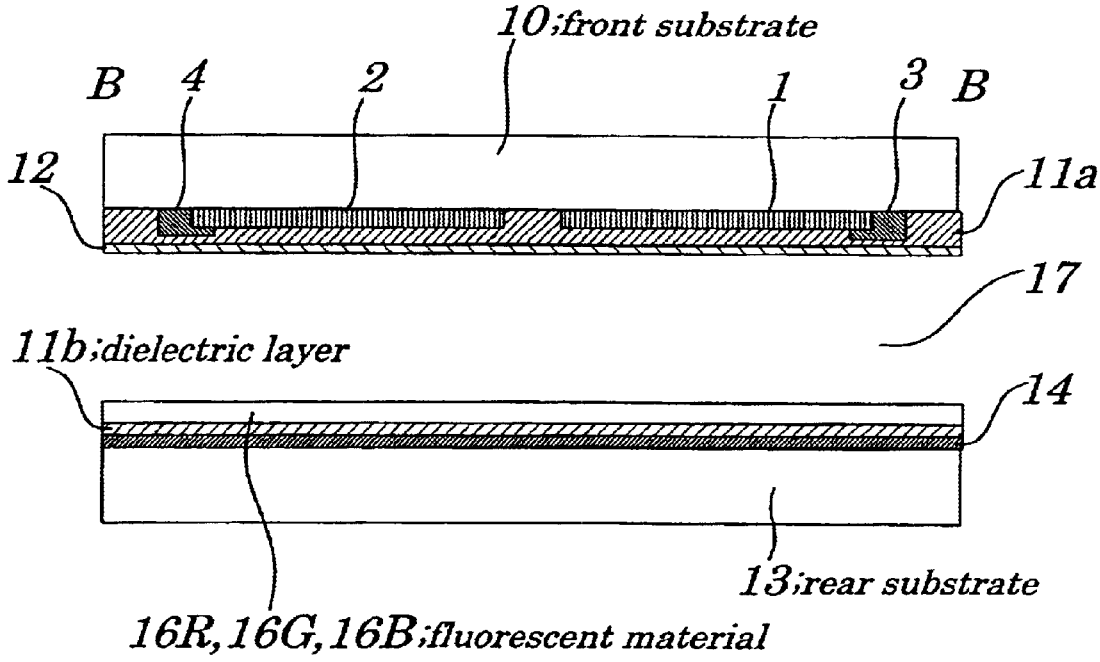
FIG. 3 is a cross-sectional view of the plasma display of FIG. 1 taken along a line B—B.

FIG. 1 is a plan view illustrating a plasma display according to a first embodiment of the present invention. FIG. 2 is a cross-sectional view illustrating the plasma display of FIG. 1 taken along a line A—A. FIG. 3 is a cross-sectional view illustrating the plasma display of FIG. 1 taken along a line B—B.

The plasma display panel of the first embodiment is made up of a front substrate (first substrate) 10 and a rear substrate (second substrate) 13 placed in a manner so as to face the front substrate 10 and of a plurality of discharge cells (maybe referred to as unit cells) 9 each being mounted in a matrix form between the front substrate 10 and the rear substrate 13. Gas (not shown) generating ultraviolet rays by discharge excitation is filled in a space between the front substrate 10 and the rear substrate 13 in a hermetic manner.

Each of the discharge cells 9 is made up of a scanning electrode 5 and a common electrode 6 placed in a manner so as to face each other with a discharge gap 7 being interposed between the scanning electrode 5 and the common electrode 6.

As shown in FIG. 1 and FIG. 3, the scanning electrode 5 is made up of a portion of a first metal electrode line 3 extending in a row direction H on a screen and a first transparent electrode 1 being connected to the first metal electrode line 3, and the common electrode 6 is made up of a portion of a second metal electrode line 4 extending in the row direction H on the screen and a second transparent electrode 2 being connected to the second metal electrode line 4.

As shown in FIG. 1 to FIG. 3, both the scanning electrode 5 and the common electrode 6 are formed on the front substrate 10 constructed of transparent substrates made of, for example, soda lime glass and are arranged in parallel to one another in the row direction H on the screen and a pair of the scanning electrode 5 and the common electrode 6 is arranged alternately (not shown) or on every third column (see FIG. 1) in a column direction V on the screen. In the embodiment, as shown in FIG. 1, in the column direction V on the screen, two scanning electrodes 5 and two common electrodes 6 are arranged alternately. A non-discharge gap 8 is sandwiched between the first metal electrode lines 3 in the pair of the scanning electrode 5 and the common electrode 6, or between the second metal electrode lines 4 in the pair of the common electrode 6 and the scanning electrode 5.

Each of the first metal electrode line 3 and the second metal electrode line 4 is made of metal such as copper, silver, aluminum, or a like. Each of the first transparent electrode 1 and the second transparent electrode 2 is constructed of a transparent material such as an ITO (Indium Tin Oxide) film, a tin oxide (NESA) film, or a like.

Each of the scanning electrode 5 and common electrode 6 is covered by a dielectric layer 11*a* made from zinc-containing frit glass, lead-containing frit glass, or a like and the dielectric layer 11*a* is covered by a protective layer 12 made of, for example, magnesium oxide (MgO).

Between scanning electrodes 5 being adjacent to each other and between common electrodes 6 being adjacent to each other is formed a plurality of partition walls 15 extending in the column direction V on the screen on the rear substrate 13. Each of the partition walls 15 is made of, for example, lead-containing frit glass.

A first transparent electrode 1 is made up of a first electrode portion 1*a*, a second electrode portion 1*b*, and a third electrode portion 1*c* each being different in a width in the row direction H on the screen from one another and being formed integrally in the column direction V on the screen.

The first electrode portion 1*a* is placed in a manner so as to be in contact with the discharge gap 7 in each of the discharge cells 9 being adjacent to each other in the row direction H on the screen and a clearance (space) on each of the partition walls 15 being narrower than width of each of the partition walls 15 is formed. In the embodiment, the clearance is 15 $\mu$m in width. However, the width of the clearance is not limited to the 15 $\mu$m and may be within a range of 10 $\mu$m to 30 $\mu$m.

The second electrode portion 1*b* is neither in contact with the discharge gap 7 nor in contact with the first metal electrode line 3 and is placed apart by 20 $\mu$m from each of the partition walls 15.

Moreover, the second electrode portion 1*b* may be positioned apart from each of the partition walls 15 within a range of 15 $\mu$m to 10 $\mu$m.

The third electrode portion 1*c* is in contact with the first metal electrode line 3 and has a width being smaller than that of the second electrode portion 1*b* in the row direction H on the screen (see FIG. 1).

When a width of the first electrode portion 1*a* is defined as W1, a width of the second electrode portion 1*b* as W2, and a width of the third electrode portion 1*c* as W3, W1>W2>W3.

As in the case of the first transparent electrode 1, the second transparent electrode 2 is made up of a first electrode portion 2*a*, a second electrode portion 2*b*, and a third electrode portion 2*c* widths of which are different from one another in the row direction H on the screen and which are formed in a consecutive manner in the column direction V on the screen.

The first electrode portion 2*a* faces the first electrode portion 1*a* of the first transparent electrode 1 and placed in contact with the discharge gap 7 in each of the discharge cells 9 being adjacent to each other in the row direction H on the screen and forms a clearance on each of the partition walls 15 being narrower than a width of the partition walls 15.

The second electrode portion 2*b* is neither in contact with the discharge gap 7 nor in contact with the second metal electrode line 4 and is placed being apart from each of the partition walls 15.

The third electrode portion 2*c* is in contact with the second metal electrode line 4 (see FIG. 1) and has a width being smaller than that of the second electrode portion 2*b* in the row direction H on the screen.

When a width of the first electrode portion 2*a* is defined as S1, a width of the second electrode portion 2*b* as S2, and a width of the third electrode portion 2*c* as S3, S1>S2>S3, and S1=W1, S2=W2, and S3=W3.

The rear substrate 13, as in the case of the front substrate 10, is constructed of a transparent substrate made of soda lime glass or a like and on the rear substrate 13 is arranged each of data electrodes 14 in a manner so as to be orthogonal to each of the scanning electrodes 5 and common electrodes 6 and in parallel to one another in the column direction V on the screen.

The data electrodes 14 are covered by a dielectric layer 1*b* made of zinc-containing frit glass, lead-containing frit glass, or a like. Each of the partition walls 15 is placed between the data electrodes 14 and is formed on the dielectric layer 11*b*.

Three discharge cells 9 being arranged in the row direction R on the screen makeup one pixel. As shown in FIG. 2, fluorescent materials 16R, 16G, and 16B respectively providing a red luminescent color, a green luminescent color, and a blue luminescent color making up three primary colors are coated alternately on a surface of the dielectric layer 11*b* and to a side of each of the partition walls 15. Known materials are used for the fluorescent materials. As the fluorescent materials 16A to provide the red color, for example, (Y, Ga) $BO_3$: Eu is used. As the fluorescent material 16G to provide the green color, for example, $Zn_2SiO_4$: Mn is used. As the fluorescent material 16B to provide the blue color, for example, $BaMgAl_{14}O_{23}$: Eu is used.

On the front substrate 10 and the rear substrate 13 are assembled integrally in a manner that the scanning electrode 5 and common electrode 6 are placed so as to be orthogonal to the data electrode 14 and also in a manner that center points of the second electrode portions 1*b* and 2*b* in the row direction H on the screen are overlain on a center point of the data electrode 14 in the row direction H on the screen and, in a discharge space 17 being formed between the two partition walls 15 being adjacent, gas for generating ultraviolet rays by discharge excitation is filled in a hermetic manner. As the gas for generating ultraviolet rays, for example, a mixed gas of Ne (Neon) and Xe (Xenon), a mixed gas of He (Helium), Ne and Xe, or a like is used.

Thus, according to the AC plasma display panel having the configurations of the embodiment, since a width of each of the first electrode portions 1*a* and 2*a* facing each other with the discharge gap 7 being interposed between the first electrode portions 1*a* and 2*a* can surely be larger than that of the conventional transparent electrode, even if a deviation in assembling between the front substrate 10 and the rear substrate 13 or a difference in contraction of the substrate caused by baking occur, a constant width can be ensured.

Generally, if a width of each of the first transparent electrode 1 and the second transparent electrode 2 facing each other in the row direction H on the screen with the discharge gap 7 being interposed between the first transparent electrode 1 and the second transparent electrode 2 is small, a discharge initiating voltage tends to become high and if the width of each of the above first transparent electrode 1 and the second transparent electrode 2 is large, the discharge initiating voltage tends to become low. However, according to the AC plasma display panel of the embodiment, it is possible to make low the discharge initiating voltage of the discharge cell 9 and to make narrow the discharge initiating voltage distribution.

For example, in a VGA (Video Graphics Array) measuring 42 inches from an upper left corner to a lowest right corner, the width of the first electrode portion 1*a* and the first electrode portion 2*a* in the row direction H on the screen is preferably 330 μm to 350 μm and the width of the first electrode portion 1*a* and first electrode portion 2*a* in the column direction V on the screen is preferably 50 μm to 80 μm. Moreover, for example, in an XGA (Extended Graphics Array) measuring 30 inches from an upper left corner to a lowest right corner, the width of the first electrode portion 1*a* and the first electrode portion 2*a* in the row direction H on the screen is preferably 140 μm to 150 μm and the width of the first electrode portion 1*a* and first electrode portion 2*a* in the column direction V on the screen is preferably 30 μm to 50 μm.

Also, according to the AC plasma display panel of the embodiment, since mounting of transparent electrode portions not affecting much the discharge initiating voltage such as transparent electrode portions in the second electrode portions 1*b* and 2*b* and third electrode portions 1*c* and 2*c* is omitted, it is possible to remove a current being not related to light emission in discharge and to improve efficiency of light emission.

However, in order to ensure absolute luminance, it is necessary that the width of each of the second electrode portions 1*b* and 2*b* in the row direction H on the screen is large enough to receive a current being related to light emission. For example, a width of the second electrode portions 1*b* and 2*b* in a VGA measuring 42 inches from an upper left corner to a lowest right corner in the row direction H on the screen is preferably 200 μm to 260 μm. Also, a width of the second electrode portions 1*b* and 2*b* in an XGA measuring 30 inches from an upper left corner to a lowest right corner in the row direction H on the screen is preferably 60 μm to 80 μm.

Moreover, in the AC plasma display panel of the embodiment, since the width of the third electrode portions 1*c* and 2*c* in the row direction H on the screen is made smaller and an amount of charges that cannot be erased completely is reduced, an erroneous discharge voltage can be made higher.

However, if the width of the third electrode portions 1*c* and 2*c* is made too smaller, since charges required for writing discharge is reduced, setting of an optimum width is necessary.

For example, the width of the third electrode portions 1*c* and 2*c* in a VGA measuring 42 inches from an upper left corner to a lowest right corner in the row direction H on the screen is preferably 50 μm to 100 μm and the width of the third electrode portions 1*c* and 2*c* in a VGA measuring 42 inches from an upper left corner to a lowest right corner in the column direction V on the screen is preferably 30 μm to 100 μm. Moreover, the width of the third electrode portions 1*c* and 2*c* in an XGA measuring 30 inches from an upper left corner to a lowest right corner in the row direction H on the screen is preferably 20 μm to 50 μm and the width of the third electrode portions 1*c* and 2*c* in the XGA measuring 30 inches from an upper left corner to a lowest right corner in the column direction V on the screen is preferably 20 μm to 30 μm. This makes a wider driving margin, achieves stable operations, and can improve efficiency of light emission.

Second Embodiment

Figure 4:
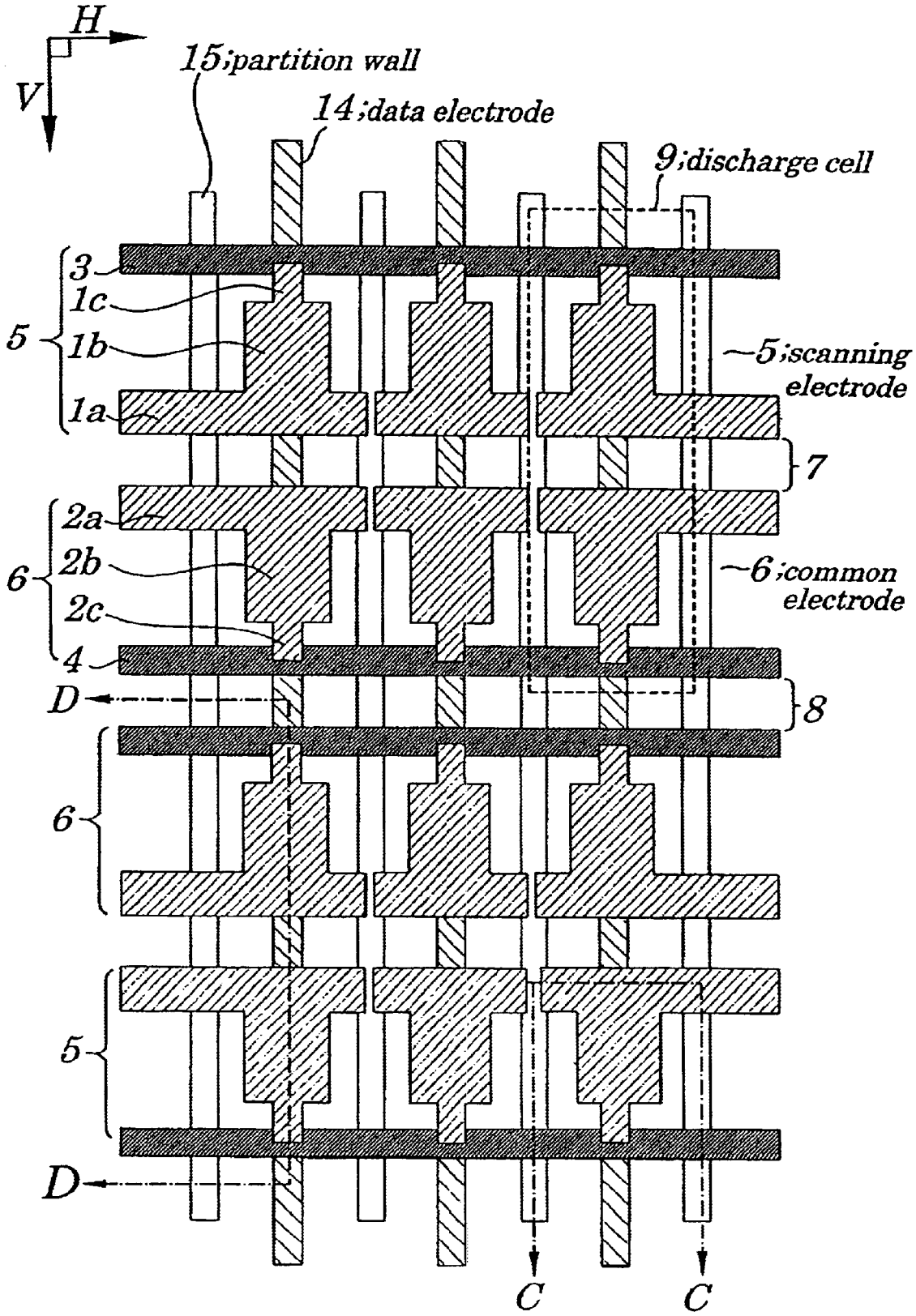
FIG. 4 is a plan view showing configurations of a plasma display panel according to, a second embodiment of the present invention.
Figure 5:
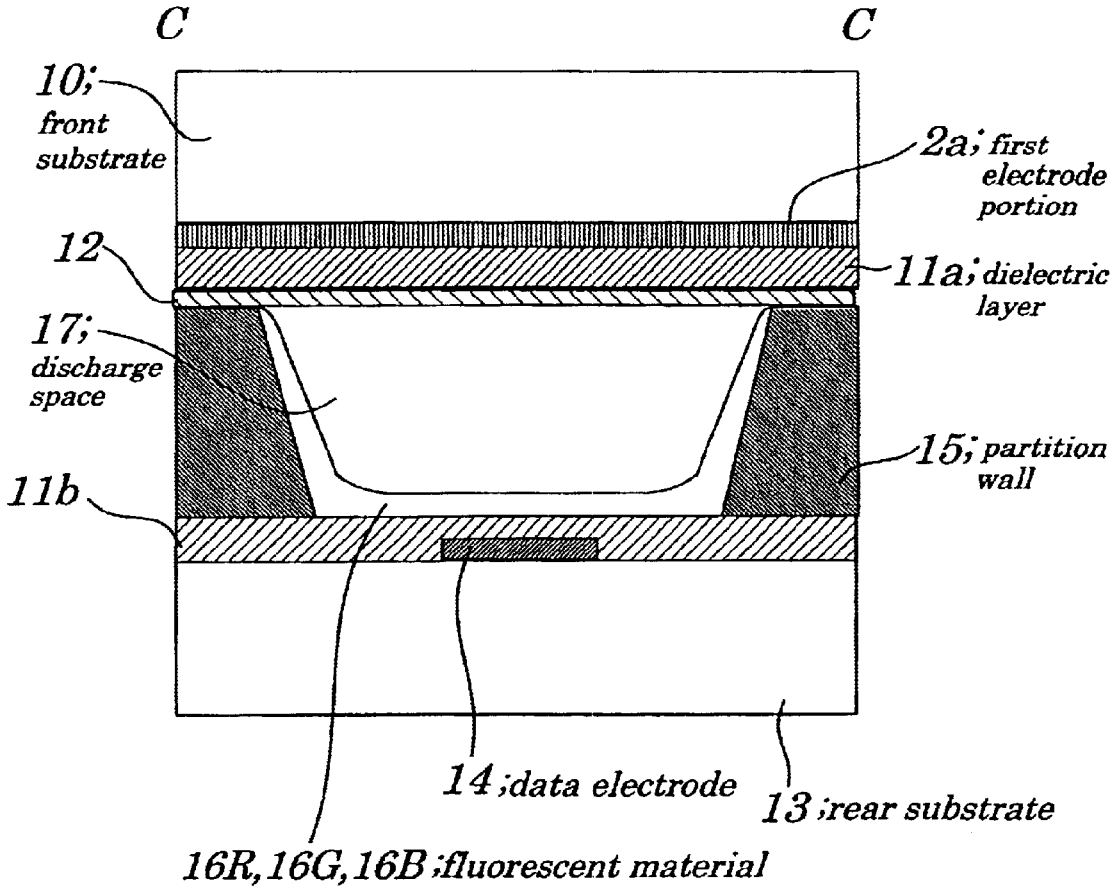
FIG. 5 is a cross-sectional view of the plasma display panel of FIG. 4 taken from a line C—C.
Figure 6:
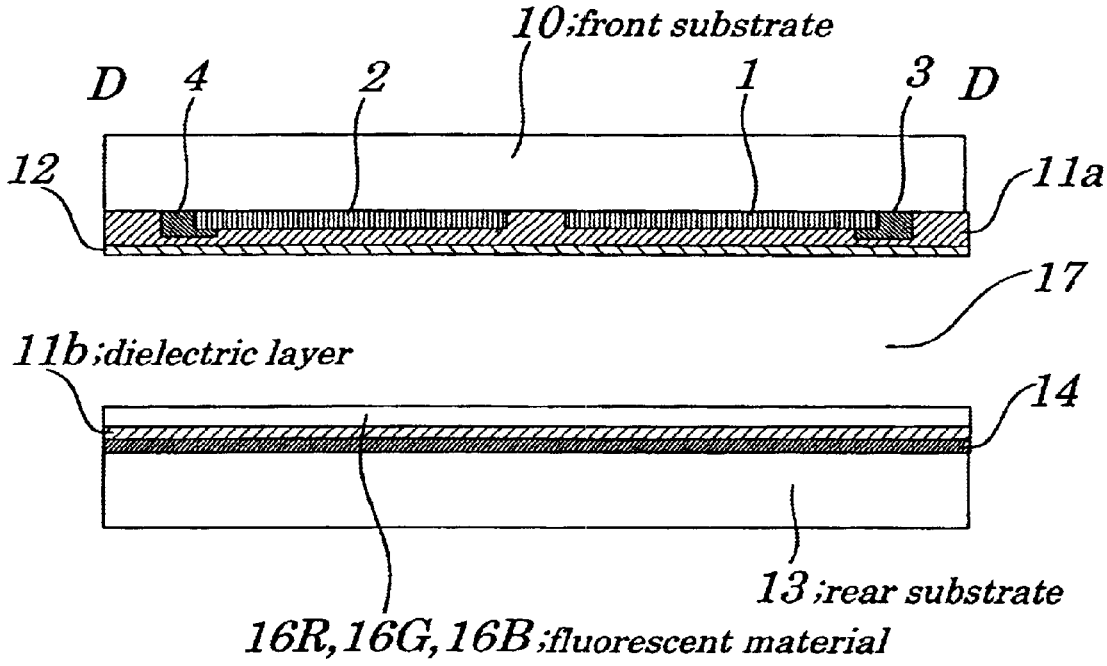
FIG. 6 is a cross-sectional view of the plasma display panel of FIG. 4 taken from a line D—D.
Figure 7:
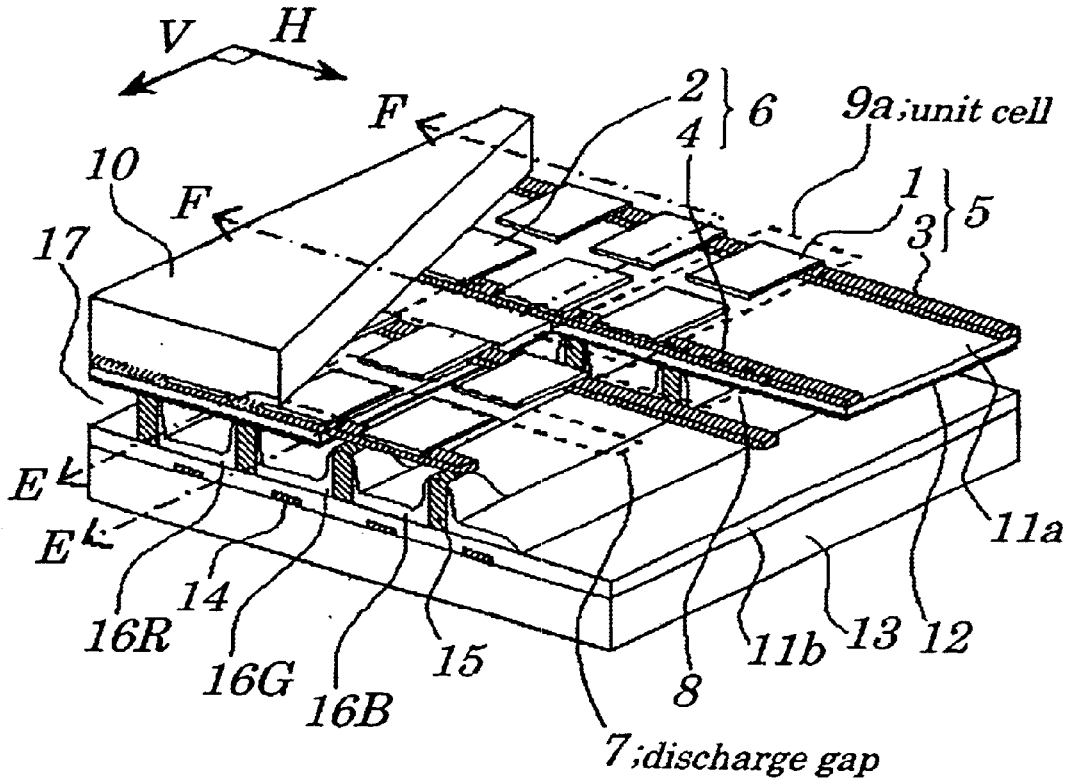
FIG. 7 (PRIOR ART)
FIG. 7 is a cut-away perspective view illustrating configurations of a conventional plasma display panel.
Figure 8:
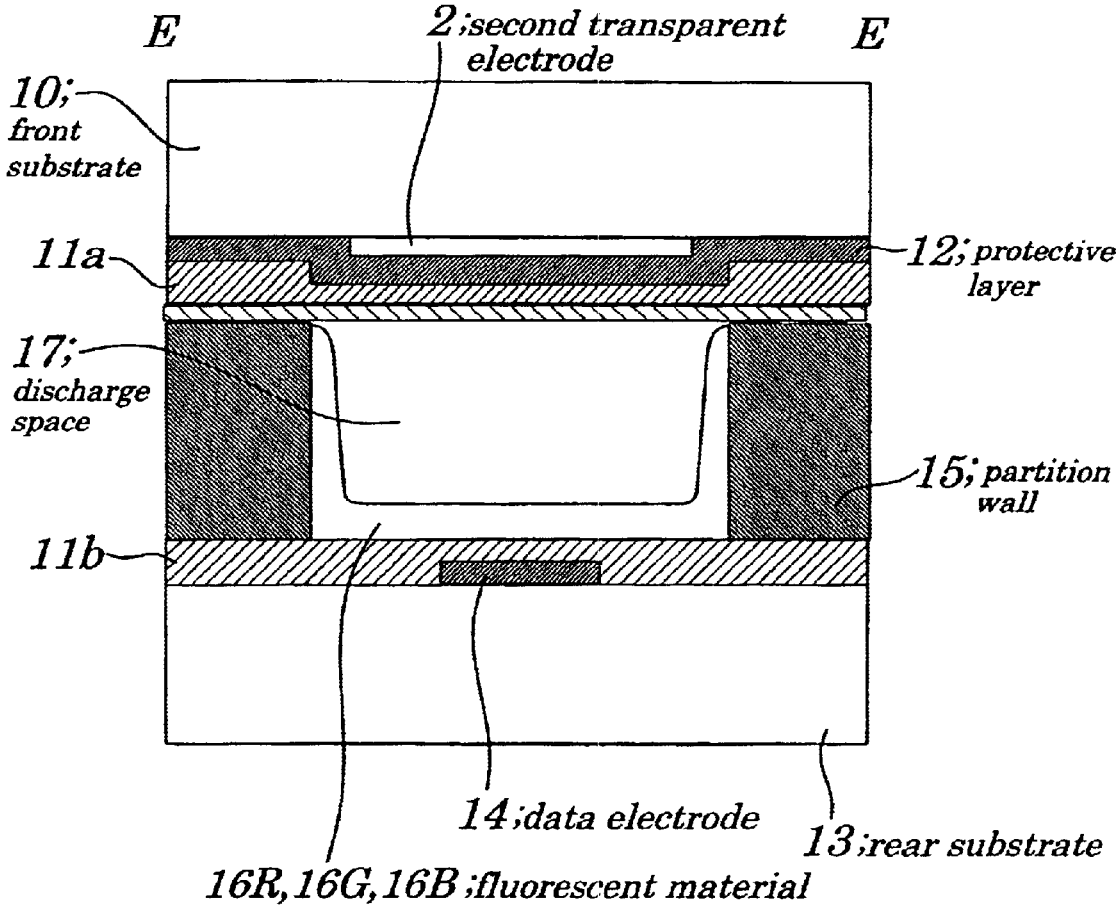
FIG.8 (PRIOR ART)
FIG. 8 is a cross-sectional view of the conventional plasma display panel of FIG. 7 taken along a line E—E.
Figure 9:
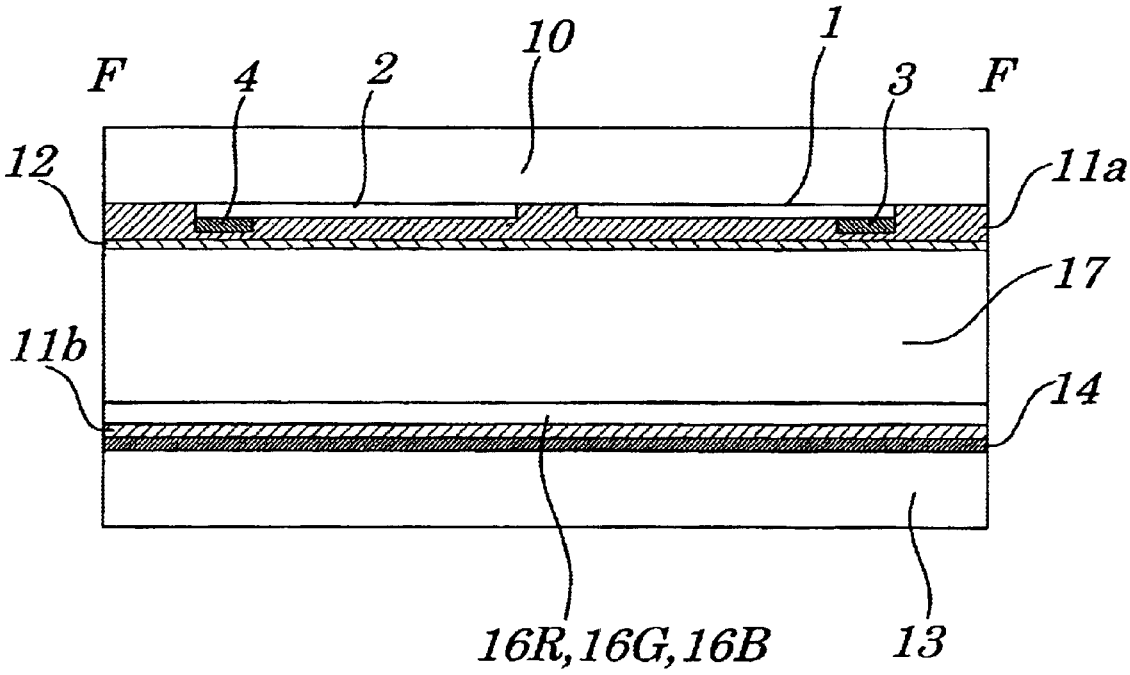
FIG.9 (PRIOR ART)
FIG. 9 is a cross-sectional view of the conventional plasma display panel of FIG. 8 taken along a line F—F.

FIG. 4 is a plan view showing configurations of an AC plasma display panel according to a second embodiment of the present invention. FIG. 5 is a cross-sectional view of the AC plasma display panel of FIG. 4 taken from a line C—C. FIG. 6 is a cross-sectional view of the AC plasma display panel of FIG. 4 taken from a line D—D.

The AC plasma display panel of the second embodiment is constructed of a front substrate (first substrate) 10, a rear substrate (second, substrate) 13 being positioned to face the front substrate 10, and a plurality of discharge cells (may be referred to as unit cells) 9 placed in a matrix form between the front substrate 10 and the rear substrate 13. Between the front substrate 10 and the rear substrate 13 is filled gas (not shown) generating ultraviolet rays by discharge excitation in a hermetic form.

Each of the discharge cells 9 is made up of a scanning electrode 5 and a common electrode 6 positioned so as to face the scanning electrode 5 with a discharge gap 7 being interposed between the scanning electrode 5 and the common electrode 6.

The scanning electrode 5 is made up of a first metal electrode line 3 extending in a row direction H on a screen and a first transparent electrode 1 (see FIG. 6) being connected to the first metal electrode line 3. The common electrode 6 is made up of a second metal electrode line 4 extending in the row direction H on the screen and a second transparent electrode 2 being connected to the second metal electrode line 4 (see FIG. 6).

As shown in FIG. 4 to FIG. 6, both the scanning electrode 5 and the common electrode 6 are formed on the front substrate 10 constructed of a transparent substrate made of, for example, soda lime glass and are arranged in parallel to one another in the row direction H on the screen and a pair of the scanning electrode 5 and the common electrode 6 is arranged alternately (not shown) or on every third column (see FIG. 4) in the column direction V on the screen. In the second embodiment, as shown in FIG. 4, in the column direction V on the screen, two scanning electrodes 5 and two common electrodes 6 are arranged alternately. A non-discharge gap 8 is sandwiched between the first metal electrode lines 3 in the pair of the scanning electrode 5 and the common electrode 6, or between the second metal electrode lines 4 in the pair of the common electrode 6 and the scanning electrode 5.

The first metal electrode line 3 and second metal electrode line 4 are made of, for example, metals such as copper, silver, aluminum, or a like and the first transparent electrode 1 and second transparent electrode 2 are made of transparent materials such as ITO (Indium Tin Oxide) or tin oxide (NESA), or a like.

The scanning electrode 5 and common electrode 6 are covered by a dielectric layer 11*a* made of zinc-containing frit glass, lead-containing trit glass, or a like and the dielectric layer 11*a* is covered by a protective layer 12 made of, for example, magnesium oxide (MgO).

Between the scanning electrodes 5 being adjacent to each other and between the common electrodes 6 being adjacent to each other on the rear substance 13 is formed a plurality of partition walls 15 extending in a column direction V on the screen. Each of the partition walls 15 is made of, for example, lead-containing frit glass or a like.

The first transparent electrode 1 is made up of a first electrode portion 1*a*, a second electrode portion 1*b*, and a third electrode portion 1*c* each having a different width in the row direction H on the screen and being formed integrally in the column direction V on the screen.

The first electrode portion 1*a* is in contact with the discharge gap 7 mounted in each of the discharge cells 9 being adjacent to one another in the row direction H on the screen and connects discharge cells 9 to one another. That is, in the first embodiment, the first electrode portion 1*a* is formed independently for each discharge cell 9. However, in the second embodiment, the first electrode portion 1*a* is formed as one line extending in the row direction H on the screen and has a function of connecting the discharge cells 9 to one another.

The second electrode portion 1*b* is so constructed that it is never in contact with the discharge gap 7 nor with the first metal electrode line 3 and is formed apart from each of the partition walls 15.

The third electrode portion 1*c* is in contact with the first metal electrode line 3 (see FIG. 1) and has a width being smaller than that of the second electrode portion 1*b* in the row direction H on the screen.

When a width of the first electrode portion 1*a* is defined as W1, a width of the second electrode portion 1*b* as W2, and a width of the third electrode portion 1*c* as W3, W1>W2>W3.

As in the case of the first transparent electrode 1, the second transparent electrode 2 is made up of a first electrode portion 2*a*, a second electrode portion 2*b*, and a third electrode portion 2*c* each having a different width in the row direction H on the screen and being formed integrally in the, column direction V on the screen.

The first electrode portion 2*a* is in contact with the discharge gap 7 mounted in each of the discharge cells 9 being adjacent to one another in the row direction H on the screen and connects discharge cells 9 to one another. That is, in the first embodiment, the first electrode portion 2*a* is formed as one line extending in the row direction H on the screen and has a function of connecting discharge cells 9 to one another.

The second electrode portion 2*b* is so constructed that it is never in contact with the discharge gap 7 nor with the first metal electrode line 3 and is formed apart at a distance of 20 $\mu$m from each of the partition walls 15.

Moreover, the second electrode portion 2*b* may be placed within a range of 10 $\mu$m to 50 $\mu$m from each of the partition walls 15.

The third electrode portion 2*c* is in contact with the second metal electrode line 4 (see FIG. 1) and has a width being smaller than that of the second electrode portion 2*b* in the row direction H on the screen.

When a width of the first electrode portion 2*a* is defined as S1, a width of the second electrode portion 2*b* as S2, and a width of the third electrode portion 2*c* as S3, S1>S2>S3 and S1=W1, S=W2, and S3=W3.

The rear substrate 13, as in the case of the front substrate 10, is constructed of a transparent substrate made of soda lime glass or a like and on the rear substrate 13 are arranged data electrodes 14 made of a metal such as copper, silver, aluminum, or a like in parallel in the column direction V on the screen in a manner so as to be orthogonal to the scanning electrode 5 and common electrode 6.

The data electrode 14 is covered by a dielectric layer 11*b* made of zinc-containing frit glass, lead-containing frit glass, or a like. Each of the above-described partition walls 15 is formed between the data electrodes 14 on the dielectric layer 11*b*.

Three discharge cells 9 being arranged in the tow direction H on the screen make up one pixel. As shown in FIG. 5, fluorescent materials 16R, 16G, and 16B respectively providing a red color, a green color, and a blue color making up three primary colors, respectively, are alternately coated (That is to say R, G, B, R, G, B, . . . ) on a surface a surface of the dielectric layer 11*b* and to a side of each of the partition walls 15. As materials for the fluorescent materials 16R, 16G, and 16B, known materials can be used. That is, as the fluorescent material 16R to provide the red color, for example, (Y, Ga) $BO_3$: Eu is used. As the fluorescent material 16G to provide the green color, for example, $Zn_2SiO_4$:Mn is used. As the fluorescent material 16B to provide the blue color, for example, $BaMgAl_{14}O_{23}$: Eu is used.

Between the front substrate 10 and the rear substrate 13 are integrally assembled the scanning electrode 5, common electrode 6, and data electrode 14 in a manner that they face one another in a manner so as to be orthogonal to one another and that center points of the second electrode portions 1*b* and 2*b* in the row direction H on the screen are overlaid on center points of the data electrode 14 in the row direction H on the screen and in a discharge space 17 being a space between the front substrate 10 and the rear substrate 13 is filled ultraviolet ray generating gas which emits ultraviolet rays by discharge excitation. As the gas for generating ultraviolet rays, for example, a mixed gas of Ne (Neon) with Xe (Xenon), a mixed gas of He (Helium) with Ne, or a like is used.

Thus, according to the AC plasma display panel having the configurations of the embodiment, since a width of each of the first electrode portions 1*a* and 2*a* facing each other with the discharge gap 7 being interposed between the first electrode portions 1*a* and 2*a* can surely be larger compared with the case of the conventional transparent electrode, even if a deviation in assembling between the front substrate 10 and the rear substrate 13 or a difference in contraction of the substrate caused by baking occur, a constant width can be ensured.

Generally, if a width of each of the first transparent electrode 1 and the second transparent electrode 2 facing each other in the row direction H on the screen with the discharge gap 7 being interposed between the first transparent electrode 1 and he second transparent electrode 2 is small, a discharge initiating voltage tends to become high and if the width of each of the above first transparent electrode 1 and the second transparent electrode 2 are large, the discharge initiating voltage tends to become low. However, according to the plasma display panel of the embodiment, it is possible to make low the discharge initiating voltage of the discharge cell 9 and to make narrow the discharge initiating voltage distribution.

For example, in a VGA measuring 42 inches from an upper left corner to a lowest right corner, the width of the first electrode portion 1*a* and the second electrode portion 2*a* in the row direction H on the screen is preferably 50 $\mu$m to 80 $\mu$m. Moreover, in an XGA measuring 30 inches from an upper left corner to a lowest right corner, the width of the first electrode portion 1*a* and second electrode portion 2*a* in the column direction V on the screen is preferably 30 $\mu$m to 50 $\mu$m.

Also, according to the AC plasma display panel of the embodiment, since mounting of transparent electrode portions not affecting much the discharge initiating voltage such as transparent electrode portions in the second electrode portions 1*b* and 2*b* and third electrode portions 1*c* and 2*c* is omitted, it is possible to remove a current being not related to light emission in discharge and to improve efficiency of light emission.

However, in order to ensure absolute luminance, it is necessary that the width of each of the second electrode portions 1*b* and 2*b* in the row direction H on the screen are large enough to receive a current being related to light emission. For example, a width of the second electrode portions 1*b* and 2*b* in a VGA measuring 42 inches from an upper left corner to a lowest right corner in the row direction H on the screen is preferably 200 $\mu$m to 260 $\mu$m. Also, a width of the second electrode portions 1*b* and 2*b* in an XGA measuring 30 inches from an upper left corner to a lowest right corner in the row direction R on the screen is preferably 60 $\mu$m to 80 $\mu$m.

Moreover, in the AC plasma display panel of the embodiment, since the width of the third electrode portions 1*c* and 2*c* in the row direction H on the screen is made smaller and an amount of charges that cannot be erased completely is reduced, an erroneous discharge voltage can be made higher.

However, if a width of the third electrode portions 1*c* and 2*c* in the row direction H on the screen is made excessively small, charges required for writing discharge are reduced and since writing discharge voltage becomes high, optimum setting of the width is required.

For example, in a VGA measuring 42 inches from an upper left corner to a lowest right corner, the width of the third electrode portions 1*c* and 2*c* in the row direction H on the screen is preferably 50 $\mu$m to 100 $\mu$m and the width of the third electrode portions 1*c* and 2*c* in the column direction V on the screen is preferably 30 $\mu$m to 100 $\mu$m. Moreover, for example, in an XGA measuring 30 inches from an upper left corner to a lowest right corner, the width of the third electrode portion 1*e* and 2*c* in the row direction H on the screen is preferably 20 $\mu$m to 50 $\mu$m and the width of the third electrode portions 1*c* and 2*c* in the column direction V on the screen is preferably 20 $\mu$m to 30 $\mu$m. This makes a driving margin wider and enables stable operation to be achieved and efficiency of light emission to be improved.

Moreover, in the AC plasma display panel of the embodiment, since the first electrode portions 1*a* and 2*a* are connected to each other in each of the discharge cells 9 in the row direction H on the screen, even if an electrical connection with the first metal electrode line 3 or with the second metal electrode line 4 is broken due to breakage between the third electrode portions 1*c* and 2*c*, a current can be fed through the first electrode portions 1*a* and 2*a* from discharge cells 9 being adjacent to each other and therefore it is possible to operate each discharge cell 9 in a stable manner.

The present invention is not limited to the above embodiments but maybe changed and modified without departing from the scope and spirit of the invention. For example, arrangement of the scanning electrode 5 and common electrode 6 in the column direction V on the screen is not limited to the case of the present invention. In the above first and second embodiments, as shown in FIG. 1 and FIG. 4, the electrodes are arranged in order of the scanning electrode 5, common electrode 6, common electrode 6, scanning electrode 5 and scanning electrode 5 . . . , however, the electrodes may be arranged in order of the common electrode 6, scanning electrode 5, scanning electrode 5, common electrode 6, common electrode 6 . . . , or in order of the scanning electrode 5, common electrode 6, scanning electrode 5, common electrode 6 . . . , or in order of the common electrode 6, scanning electrode 5, common electrode 6, scanning electrode 5 . . . .

Moreover, a shape of each of the partition walls 15 is not limited to the case of the present invention and, instead of each of the belt-shaped partition walls 15 employed in the embodiment, each of partition walls being of a parallel cross shape may be employed.

Moreover, a shape and arrangement of the discharge cell 9 are not limited to the case of the present invention. Instead of forming one pixel having a rectangular shape by arranging three discharge cells 9 in the row direction H on the screen as shown in the first and second embodiments, it is possible to form, for example, one pixel of a hexagonal shape by three discharge cells arranged on each crest of a triangle.

It is thus apparent that the present invention is not limited to the above embodiments but may be changed and modified without departing from the scope and spirit of the invention.

What is claimed is:

1. A plasma display panel comprising:

a first substrate made up of a transparent material;

a second substrate placed in a manner so as to face said first substrate wherein gas generating ultraviolet rays by discharge excitation is filled in a hermetic manner between said first substrate and said second substrate;

a plurality of transparent electrodes formed on said first substrate, each of which is made up of a first electrode portion, a second electrode portion, and a third electrode portion each being different in a width in a row direction on a screen from;

a plurality of metal electrode lines extending in said row direction and connected to said transparent electrodes;

a plurality of discharge gap formed between said transparent electrodes being adjacent to each other in a column direction;

a plurality of discharge cells made up of a pair of the transparent electrodes out of said plurality of said transparent electrodes, and arranged in a matrix form in a space between said first substrate and said second substrate; and wherein, in each of said plurality of said discharge cells, said first electrode portion exists in a vicinity of the discharge gap formed on said first substrate or in contact with said discharge gap, both end portions which are respectively positioned on a partition wall between the discharge cells being adjacent to each other in a row direction on a screen, whereby a clearance between end portions of said first electrode portions being adjacent to each other in said row direction is smaller than a width of said partition wall, said second electrode portion is formed apparent from the metal electrode line, from said discharge gap and from said partition wall, and said third electrode portion in said row direction on said screen is formed in a vicinity of said metal electrode line or in contact with said metal electrode line, a width of said third electrode portion being smaller than that of said second electrode portion.

2. The plasma display panel according to claim 1, wherein a width of each of said first electrode portions in said column direction on said screen is 30 $\mu$m to 80$\mu$m.

3. The plasma display panel according to claim 1, wherein each of said second electrode portions is formed apart from each of said partition walls by 10 $\mu$m to 50 $\mu$m.

4. The plasma display panel according to claim 1, wherein a width of each of said first electrode portions in said row direction on said screen is 20 $\mu$m to 100 $\mu$m.

5. The plasma display panel according to claim 1, wherein a width of each of said third electrode portions in said column direction on said screen is 20 $\mu$m to 100 $\mu$m.

6. The plasma display panel according to claim 1, wherein a clearance between end portions of said first electrode portions being adjacent to each other in said row direction on said screen is 10 $\mu$m to 30 $\mu$m.

7. A plasma display panel comprising:

a first substrate made up of a transparent material;

a second substrate being placed in a manner so as to face said first substrate wherein gas generating ultraviolet rays by discharge excitation is filled in a hermetic manner between said first substrate and said second substrate;

a plurality of discharge cells arranged in a matrix form in a space between said first substrate and said second substrate; and wherein each of said plurality of discharge cells is made up of a scanning electrode and a common electrode facing said scanning electrode through a discharge gap;

wherein said scanning electrode is made up of a first metal electrode line extending in a row direction on a screen and a first transparent electrode being connected to said first metal electrode line;

wherein said common electrode is made up of a second metal electrode line extending in said row direction on said screen and a second transparent electrode being connected to said second metal electrode line;

wherein each of partition walls extending in a column direction on said screen is formed between said scanning electrodes being adjacent to each other and between said common electrodes being adjacent to each other on said second substrate;

wherein each of said first transparent electrode and said second transparent electrode is made up of a first electrode portion, a second electrode portion and a third electrode portion each having a different width in said row direction on said screen and being formed integrally in said column direction on said screen;

wherein said first electrode portion exists in a vicinity of the discharge gap formed on said first substrate or in contact with said discharge gap, both end portions which are respectively positioned on a partition wall between the discharge cells being adjacent to each other in a row direction on a screen, whereby a clearance between end portions of said first electrode portions being adjacent to each other in said row direction is smaller than a width of said partition wall, wherein said second electrode portion is formed apparent from the metal electrode line, from said discharge gap and from said partition wall, and wherein said third electrode portion in said row direction on said screen is formed in a vicinity of said metal electrode line or in contact with said metal electrode line, a width of said third electrode portion being smaller than that of said second electrode portion.

8. The plasma display panel according to claim 7, wherein a width of each of said first electrode portions in said column direction on said screen is 30 $\mu$m to 80 $\mu$m.

9. The plasma display panel according to claim 7, wherein each of said second electrode portions is formed apart from each of said partition walls by 10 $\mu$m to 50 $\mu$m.

10. The plasma display panel according to claim 7, wherein a width of each of said first electrode portions in said row direction on said screen is 20 $\mu$m to 100 $\mu$m.

11. The plasma display panel according to claim 7, wherein a width of each of said third electrode portions in said column direction on said screen is 20 $\mu$m to 100 $\mu$m.

12. The plasma display panel according to claim 7, wherein a clearance between end portions of said first electrode portions being adjacent to each other in said row direction on said screen is 10 $\mu$m to 30 $\mu$m.

13. A plasma display panel comprising:

a first substrate made up of a transparent material;

a second substrate placed in a manner so as to face said first substrate wherein gas generating ultraviolet rays by discharge excitation is filled in a hermetic manner between said first substrate and said second substrate;

a plurality of transparent electrodes formed on said first substrate, each of which is made up of a first electrode portion, a second electrode portion, and a third electrode portion each being different in a width in a row direction on a screen from;

a plurality of metal electrode lines extending in said row direction and connected to said transparent electrodes;

a plurality of discharge gap formed between said transparent electrodes being adjacent to each other in a column direction;

a plurality of discharge cells made up of a pair of the transparent electrodes out of said plurality of said transparent electrodes, and arranged in a matrix form in a space between said first substrate and said second substrate; and wherein, in each of said plurality of said discharge cells, said first electrode portion is connected to another first electrode portion in the adjacent discharge cell in said row direction on said screen, said second electrode portion is formed apparent from the metal electrode line, from said discharge gap and from said partition wall, and said third electrode portion in said row direction on said screen is formed in a vicinity of said metal electrode line or in contact with said metal electrode line, a width of said third electrode portion being smaller than that of said second electrode portion.

14. The plasma display panel according to claim 13, wherein a width of each of said first electrode portions in said column direction on said screen is 30 $\mu$m to 80 $\mu$m.

15. The plasma display panel according to claim 13, wherein each of said second electrode portions is formed apart from each of said partition walls by 10 $\mu$m to 50 $\mu$m.

16. The plasma display panel according to claim 13, wherein a width of each of said first electrode portions in said row direction on said screen is 20 $\mu$m to 100 $\mu$m.

17. The plasma display panel according to claim 13, wherein a width of each of said third electrode portions in said column direction on said screen is 20 $\mu$m to 100 $\mu$m.

18. A plasma display panel comprising:

a first substrate made up of a transparent material;

a second substrate being placed in a manner so as to face said first substrate wherein gas generating ultraviolet rays by discharge excitation is filled in a hermetic manner between said first substrate and said second substrate;

a plurality of discharge cells arranged in a matrix form in a space between said first substrate and said second substrate; and wherein each of said discharge cells is made up of a scanning electrode and a common electrode facing said scanning electrode through a discharge gap;

wherein said scanning electrode is made up of a first metal electrode line extending in a row direction on a screen and a first transparent electrode being connected to said first metal electrode line;

wherein said common electrode is made up of a second metal electrode line extending in said row direction on said screen and a second transparent electrode being connected to said second metal electrode line;

wherein each of partition walls extending in a column direction on said screen is formed between said scanning electrodes being adjacent to each other and between said common electrodes being adjacent to each other on said second substrate;

wherein each of said first transparent electrode and said second transparent electrode is made up of a first electrode portion, a second electrode portion and a third electrode portion each having a different width in said row direction on said screen and being formed integrally in said column direction on said screen;

wherein, in each of said plurality of said discharge cells, said first electrode portion is connected to another first electrode portion in the adjacent discharge cell in said row direction on said screen, wherein said second electrode portion is formed apparent from the metal electrode line, from said discharge gap and from said partition wall, and wherein said third electrode portion in said row direction on said screen is formed in a vicinity of said metal electrode line or in contact with said metal electrode line, a width of said third electrode portion being smaller than that of said second electrode portion.

19. The plasma display panel according to claim 18, wherein a width of each of said first electrode portions in said column direction on said screen is 30 $\mu$m to 80 $\mu$m.

20. The plasma display panel according to claim 18, wherein each of said second electrode portions is formed apart from each of said partition walls by 10 $\mu$m to 50 $\mu$m.

21. The plasma display panel according to claim 18, wherein a width of each of said first electrode portions in said row direction on said screen is 20 $\mu$m to 100 $\mu$m.

22. The plasma display panel according to claim 18, wherein a width of each of said third electrode portions in said column direction on said screen is 20 $\mu$m to 100 $\mu$m.

* * * * *

UNITED STATES PATENT AND TRADEMARK OFFICE

CERTIFICATE OF CORRECTION

PATENT NO. : 6,747,414 B2
DATED : June 8, 2004
INVENTOR(S) : Kunio Yoshida

It is certified that error appears in the above-identified patent and that said Letters Patent is hereby corrected as shown below:

Column 3,
Line 42, after "from" insert -- one another --.

Column 5,
Line 17, after "from" insert -- one another --.

Column 12,
Line 45, change "S=W2" to -- S2=W2 --.

Column 13,
Line 36, change "he" to -- the --.

Column 15,
Line 21, after "from" insert -- one another --.

Column 17,
Line 11, after "from" insert -- one another --.

Signed and Sealed this

Thirteenth Day of June, 2006

JON W. DUDAS
*Director of the United States Patent and Trademark Office*